US007761957B2

(12) United States Patent
Gabric

(10) Patent No.: US 7,761,957 B2
(45) Date of Patent: Jul. 27, 2010

(54) VACUUM CANISTER WITH DUAL REMOVABLE MOTORS

(75) Inventor: Andrew L. Gabric, Louisville, OH (US)

(73) Assignee: H-P Products, Inc., Louisville, OH (US)

( * ) Notice: Subject to any disclaimer, the term of this patent is extended or adjusted under 35 U.S.C. 154(b) by 52 days.

(21) Appl. No.: 12/012,893

(22) Filed: Feb. 6, 2008

(65) Prior Publication Data

US 2009/0193610 A1 Aug. 6, 2009

(51) Int. Cl.

| | |
|---|---|
| ***A47L 9/22*** | (2006.01) |
| ***A47L 11/00*** | (2006.01) |
| ***A47L 13/00*** | (2006.01) |
| ***A47L 9/02*** | (2006.01) |
| ***A47L 9/10*** | (2006.01) |
| ***A47L 9/20*** | (2006.01) |
| ***B60S 1/54*** | (2006.01) |
| ***B60S 1/64*** | (2006.01) |
| ***A63B 47/04*** | (2006.01) |
| ***A63D 5/10*** | (2006.01) |
| *A47L 9/00* | (2006.01) |

(52) U.S. Cl. ..... 15/412; 15/326; 15/314; 15/413; 15/422.2; 15/353

(58) Field of Classification Search ..... 15/301, 15/312.2, 327.1, 327.6, 412
See application file for complete search history.

(56) References Cited

U.S. PATENT DOCUMENTS

| | | | | |
|---|---|---|---|---|
| 3,127,629 | A * | 4/1964 | Miller, Jr. | 15/314 |
| 3,240,000 | A * | 3/1966 | Hayes et al. | 55/337 |
| 4,231,133 | A * | 11/1980 | Probost | 15/422.2 |
| 4,591,368 | A | 5/1986 | MacDuff | |
| 4,938,309 | A | 7/1990 | Emdy | |
| 5,311,640 | A * | 5/1994 | Holland | 15/353 |
| 6,381,803 | B1 * | 5/2002 | Berfield et al. | 15/330 |
| 6,779,228 | B2 * | 8/2004 | Plomteux et al. | 15/326 |
| 7,051,398 | B2 | 5/2006 | Smith et al. | |
| 7,080,425 | B2 | 7/2006 | Smith et al. | |
| 7,168,126 | B2 | 1/2007 | Biere | |

* cited by examiner

*Primary Examiner*—Joseph J Hail, III
*Assistant Examiner*—Jamal Daniel
(74) *Attorney, Agent, or Firm*—Sand & Sebolt

(57) ABSTRACT

A canister of a vacuum cleaning system has first and second motor support plates mounted within the canister forming an intervening chamber and an upper motor cooling chamber. An auxiliary plate is attached to the second motor plate and has a dimension sized to enable the auxiliary plate to be removed from the canister interior past auxiliary components mounted on the side wall of the canister avoiding removal of the auxiliary components. A first motor is removably mounted on the first support plate and extends through an opening formed in the second support plate and is fastened to the auxiliary plate by a plurality of fasteners. The first motor is removable from the canister interior with the auxiliary plate after unfastening the auxiliary plate from the second motor support plate. A second motor is removably seated in a retainer ring attached to the second motor support plate.

19 Claims, 7 Drawing Sheets

VACUUM CANISTER WITH DUAL REMOVABLE MOTORS

BACKGROUND OF THE INVENTION

1. Technical Field

The invention relates to vacuum canisters for use with central vacuum systems. More particularly, the invention relates to a vacuum canister having an auxiliary plate mounted within the canister on which is secured a first of a pair of dual motors mounted in series in the canister with a second motor being removably mounted on the auxiliary plate. Even more particularly, the invention relates to such a canister in which both of the motors can be easily removed from the canister for replacement or maintenance without disassembling numerous components contained in the canister.

2. Background Information

Central vacuum cleaning systems are common in newer homes and in other buildings. These systems provide a convenient and easy way for periodically vacuuming the floor or rugs in the various rooms of a building and they eliminate the need for moving cumbersome handheld units from room to room. Central vacuum systems typically include a vacuum canister, a portable hose adapted to be connected to various wall mounted receptacles of a network of conduits installed in the walls and floors of the building. The canister is usually positioned in an out of the way location in the building such as the basement, utility room or garage.

A certain type of vacuum canister includes a pair of motors mounted in series, that is, one of the motors is mounted above the other motor and is in a separate chamber from the first motor. This dual motor system enables a greater vacuum to be produced than possible with a much larger, more expensive and more powerful single motor. However, one problem that exists with such dual motors which are arranged in series is that it requires considerable disassembly of the canister components, such as the electrical components, printed circuit board, electrical connectors etc. which are usually mounted on the wall of the canister between the top opening of the canister and the motor mounting plates, in order to repair or replace the lowermost mounted motor. This increases the cost of maintenance for the homeowner should one or more of the motors need to be repaired, and in particular, the lowermost motor of the pair of vacuum producing motors.

Therefore, the need exists for an improved canister for use in a vacuum cleaning system which includes a pair of vacuum producing motors mounted in series within the canister, wherein the motors can be easily removed from the canister without disassembly and removing various components of the motor controls.

BRIEF SUMMARY OF THE INVENTION

In accordance with one feature of the invention, a pair of motors are arranged in series in the vacuum producing canister, one of which is removably mounted on a first motor mounting plate and extends through an opening formed in an adjacent second motor mounting plate for attachment to an auxiliary plate which is removably mounted on the second motor mounting plate.

A further feature of the present invention is to dimension the auxiliary motor mounting plate with at least one dimension sized to permit the auxiliary plate to be removed from the open top of the canister and past side wall mounted components avoiding the need for removal or disassembly of such components.

A further aspect of the present invention is to mount the auxiliary plate on a second motor mounting plate having an intervening gasket of an elastomeric material which provides a shock absorbing and sound baffling effect.

A still further feature of the invention is to provide the canister with a top closure plate having a pair of openings which communicate with the pair of motors to provide for the passing of cooling air into and through the pair of motors.

Another feature of the invention is to provide each of the motors with a retaining ring mounted on the separate motor mounting plates which removably seats a respective motor therein, and which contains a mounting gasket which reduces vibration and absorbs sound from the supported motor.

A further aspect of the present invention is to secure the auxiliary plate with a plurality of screws or bolts to the uppermost motor mounting plates which requires only the removal of these fasteners to permit the auxiliary plate to be manually lifted through the open top of the canister bringing with it the lowermost motor which is secured to the plate after the topmost motor has been removed from its seated position within a motor mounting ring secured on the uppermost motor mounting plate.

These features and advantages are achieved by the vacuum canister of the present invention, the general nature of which may be stated as comprising a body forming an interior chamber; a first support plate mounted in the interior chamber and forming a first motor chamber; a second support plate spaced from said first support plate and forming a second motor chamber; an auxiliary plate removably mounted on the second support plate; a first motor supported on the first support plate and extending through an opening formed in the second support plate and attached to the auxiliary plate; a second motor supported on the second support plate; and said auxiliary motor plate being configured to have at least one dimension less than an internal dimension of the canister sufficient to permit said auxiliary plate and the first motor attached thereto to be removed through an open top of canister and past components mounted within the interior chamber of the canister above said auxiliary plate.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
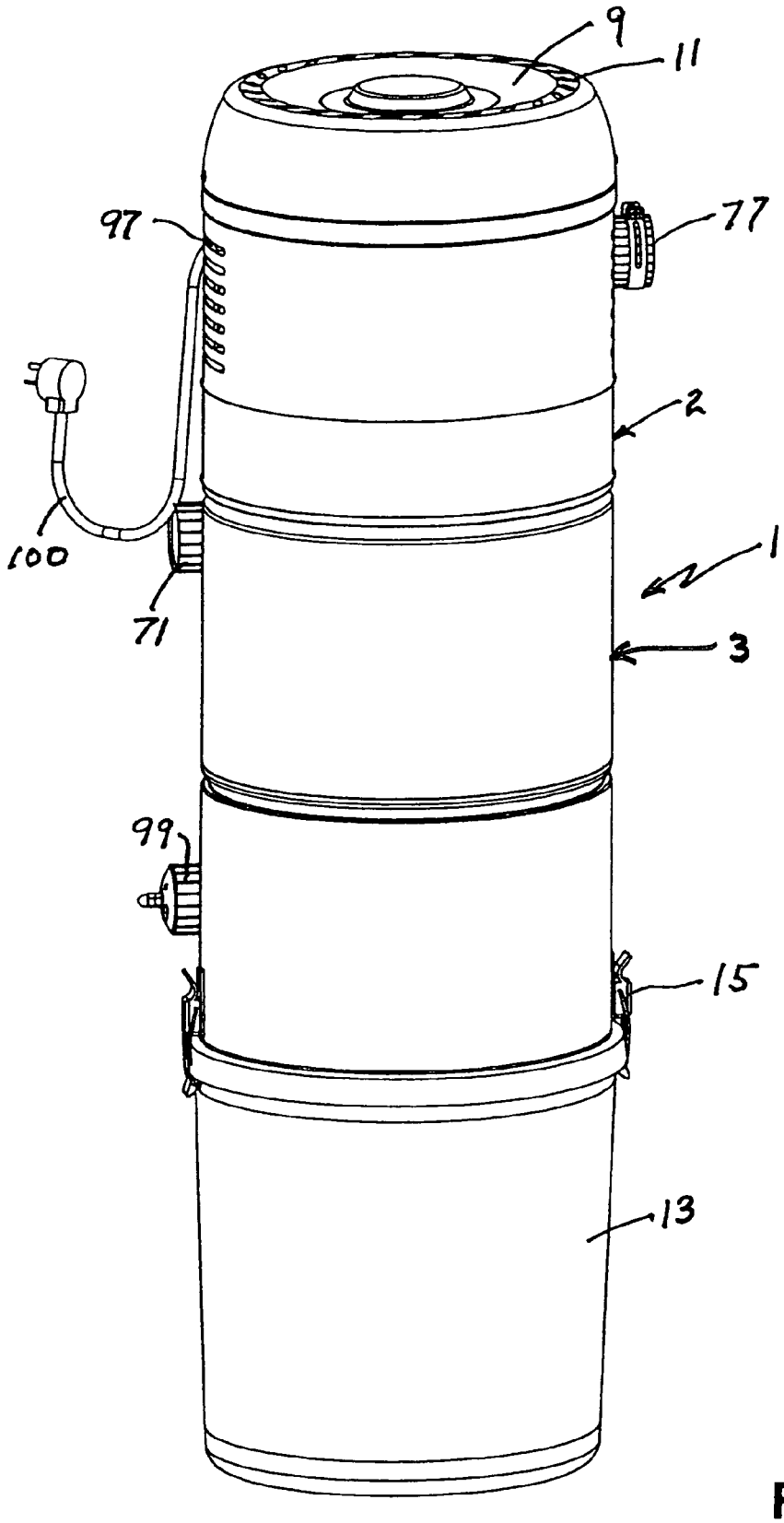
FIG. 1 is a side elevational view of the central vacuum unit of the present invention.
Figure 2:
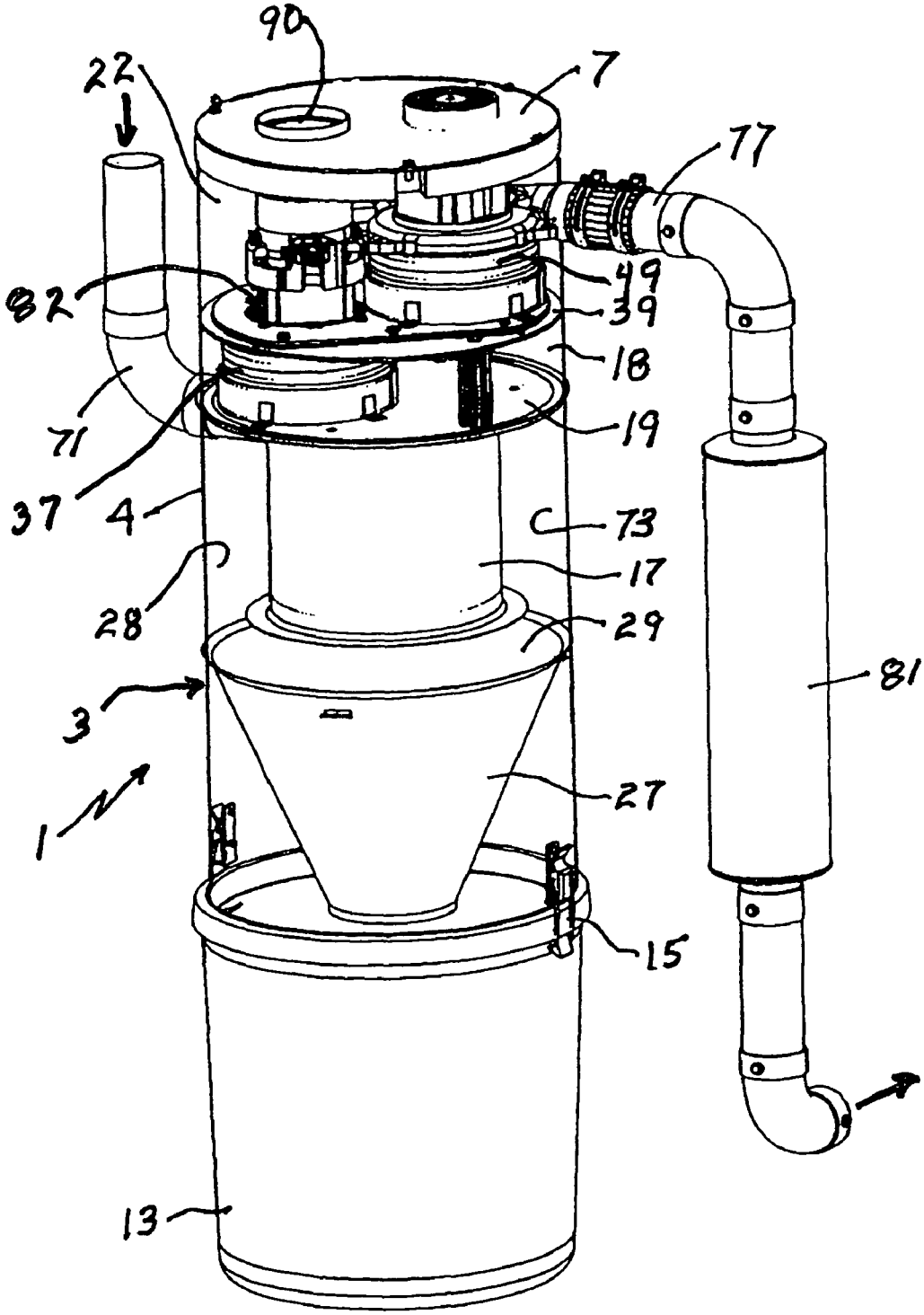
FIG. 2 is a partial view of the central vacuum unit of FIG. 1 with a portion of the outer wall of the vacuum canister broken away.

The improved central vacuum cleaning unit of the present invention is indicated generally at 1, and is shown in elevation in FIG. 1 with portions broken away and shown particularly in FIG. 2. Unit 1 includes an upper canister 2 which has a body 3 formed by a cylindrical side wall 4 with a top opening 5 (FIG. 7) on which is mounted a top closure plate 7 and an end cap 9. Cap 9 is formed with a plurality of vent holes 11 providing cooling to the various components mounted within cylindrical body 3 and discussed below. Some examples of prior art central vacuum canisters are shown in U.S. Pat. Nos. 4,591,368; 4,938,309; 6,779,228; 7,051,398; 7,168,126 and 7,080,425 which include some of the components and manner of operation as that of the present invention, the contents of which are incorporated herein by reference.

A dirt collection container 13 is mounted on the bottom of body 3 by a plurality of releasable latches 15 enabling container 13 to be easily removed from body 3 for disposal of the dirt collected therein. Most of the internal components and manner of operation of unit 1 is well known in the prior art and includes as its main components a cyclone tube or cylinder 17 (FIG. 2) which is attached to a lower motor mounting plate 19 by a plurality of fasteners 20 and an intervening ring gasket 21. A screen 23 is mounted in a bottom open end 24 of cyclone tube 17 and retained therein by an annular support plate 25. A dirt collection cone 27 (FIG. 2) is supported on canister body 3 just below bottom opening 24 and screen 23 of cyclone tube 17, and has an open top 29 through which collected dirt is discharged from a dirt collection chamber 28 and into dirt collection container 13.

Figure 3:
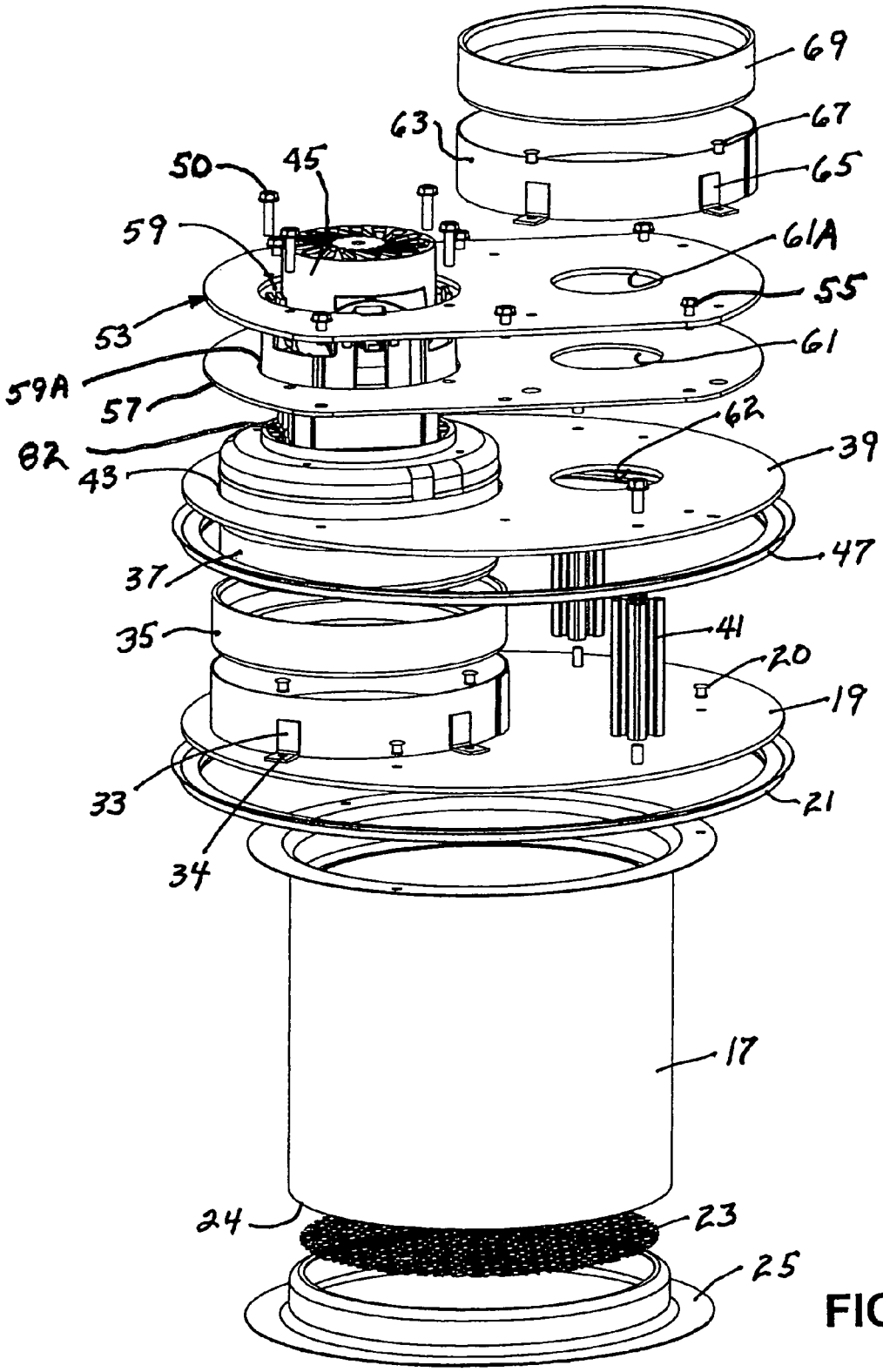
FIG. 3 is an exploded perspective view of portions of the upper portion of the vacuum canister shown in FIGS. 1 and 2.
Figure 4:
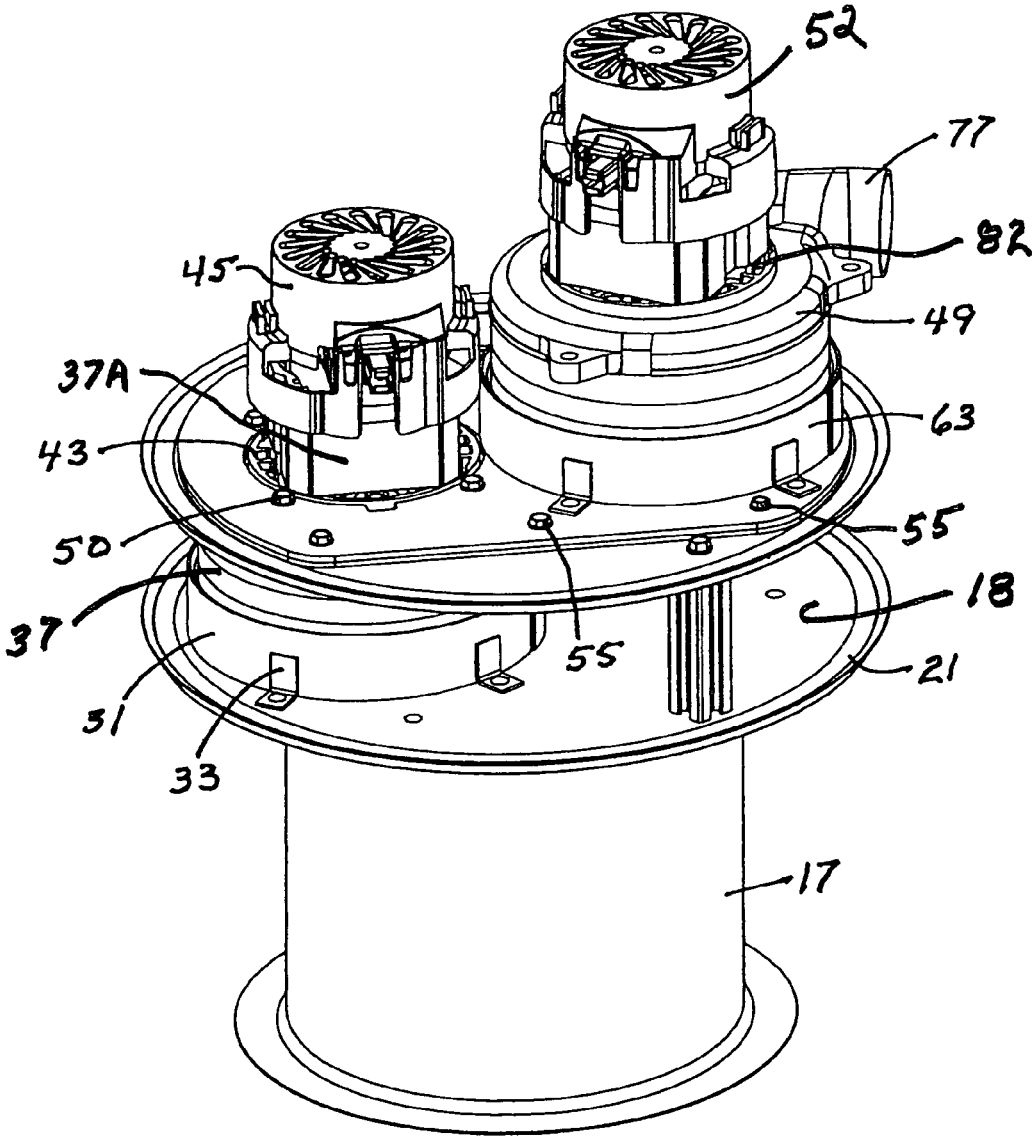
FIG. 4 is a perspective view of the dual motor assembly and attached cyclone tube arrangement.
Figure 5:
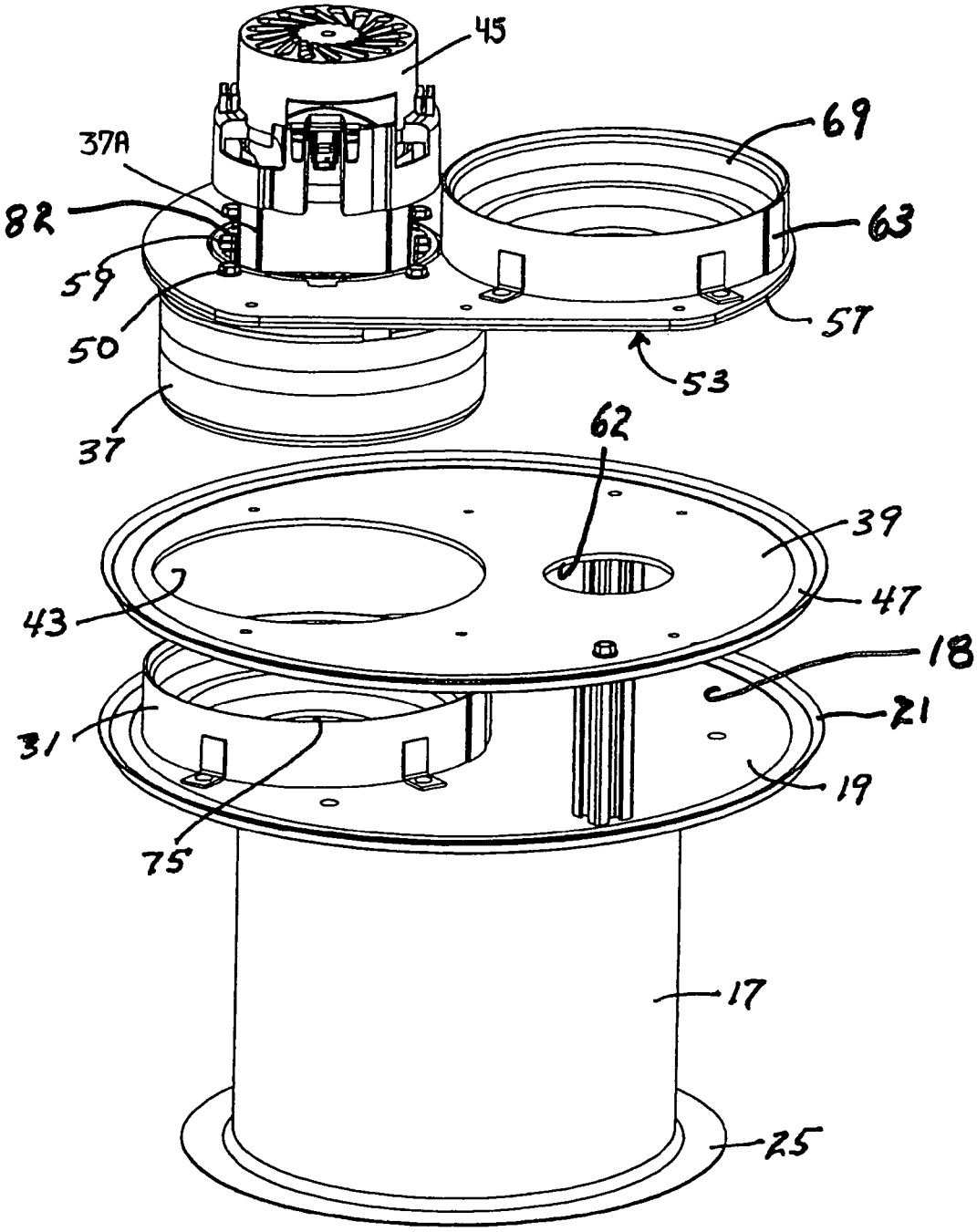
FIG. 5 is an exploded perspective view of the assembly shown in FIG. 4.

A motor positioning ring 31 is secured by a plurality of L-shaped brackets 33 and fasteners 34 on the top surface of a first motor mounting plate 19. An elastomeric gasket 35 is mounted in ring 31 for removably supporting a first or lower motor 37 therein. A second motor mounting plate 39 is mounted in a spaced relationship within canister body 3 above mounting plate 19 by a plurality of posts 41 and forms a first motor chamber 18 between plates 19 and 39, and a second motor chamber 22 above plate 39. Motor mounting plate 39 includes a first circular opening 43 through which the upper portion 37A and fan housing 45 of motor 37 extends as shown in FIGS. 3, 4 and 5. Upper motor mounting plate 39 includes a peripheral ring gasket 47 which is engaged with the side wall of cylindrical body 3 to assist in dampening vibration and sound produced by lower motor 37 and an upper motor 49 having a fan housing 52 (FIG. 4).

In accordance with the main feature of the invention, an auxiliary plate indicated generally at 53 (FIG. 3), is mounted on the top surface of upper motor mounting plate 39 by a plurality of fasteners 55 (FIG. 4). An intervening complementary-shaped elastomeric gasket 57 is mounted between auxiliary plate 53 and motor mounting plate 39 to absorb vibration, and reduce noise. Auxiliary plate 53 and gasket 57 are formed with aligned openings 59 and 59A respectively, which align with plate opening 43 through which the upper portion 37A of motor 37 extends as shown particularly in FIGS. 5 and 6. Motor 37 is secured to auxiliary plate 53 by a plurality of fasteners 50. A second motor positioning ring 63 is mounted on the top surface of auxiliary plate 53 by a plurality of L-shaped brackets 65 and fasteners 67. A ring-shaped gasket 69 is mounted within motor ring 63 (FIG. 6) to assist in reducing vibration and noise of the second or upper motor 49 when removably seated in ring 63 and gasket 69. Ring 63 and gasket 69 have bottom openings which are concentrically aligned with openings 61 and 61A formed in gasket 57 and in plate 53 respectively, and with an opening 62 formed in motor plate 39 (FIG. 5) for the passage of exhaust air through motor 49.

A vacuum conduit 71 extends through side wall 4 of canister 2 and communicates with a cyclone chamber 73 formed below lower motor mounting plate 19 (FIG. 2). The vacuum produces a swirling motion around cyclone tube 17 with the heavier dirt particles of the incoming air being directed towards side wall 4 of cylindrical body 3 where they ultimately drop into and through open top 29 of dirt collection cone 27 and into container 13. The cleaned air then moves upwardly through the open interior of cyclone tube 17 and up through an opening 75 (FIG. 5) formed in motor mounting plate 19 concentrically with motor positioning ring 31, and upwardly through a lower portion of motor 37 and into chamber 18. Screen 23 assists in removing large lightweight debris from the air stream preventing it from entering motor 37. An exhaust conduit 77 (FIG. 7) communicates directly with motor 49 which removes the dirt removal air from chamber 18 directly through motor 49 and into conduit 77 without becoming mixed with the motor cooling air in chamber 22, all of which is well known in the central vacuum cleaning art. As shown in FIG. 2, exhaust conduit 77 preferably extends through a muffler 81 before exiting through a wall or into a remote location, preferably outside of the building in which canister 1 is mounted, if possible. Thus, any small dirt particles remaining in the air stream is transmitted to the outside environment and not inside the building.

Figure 7:
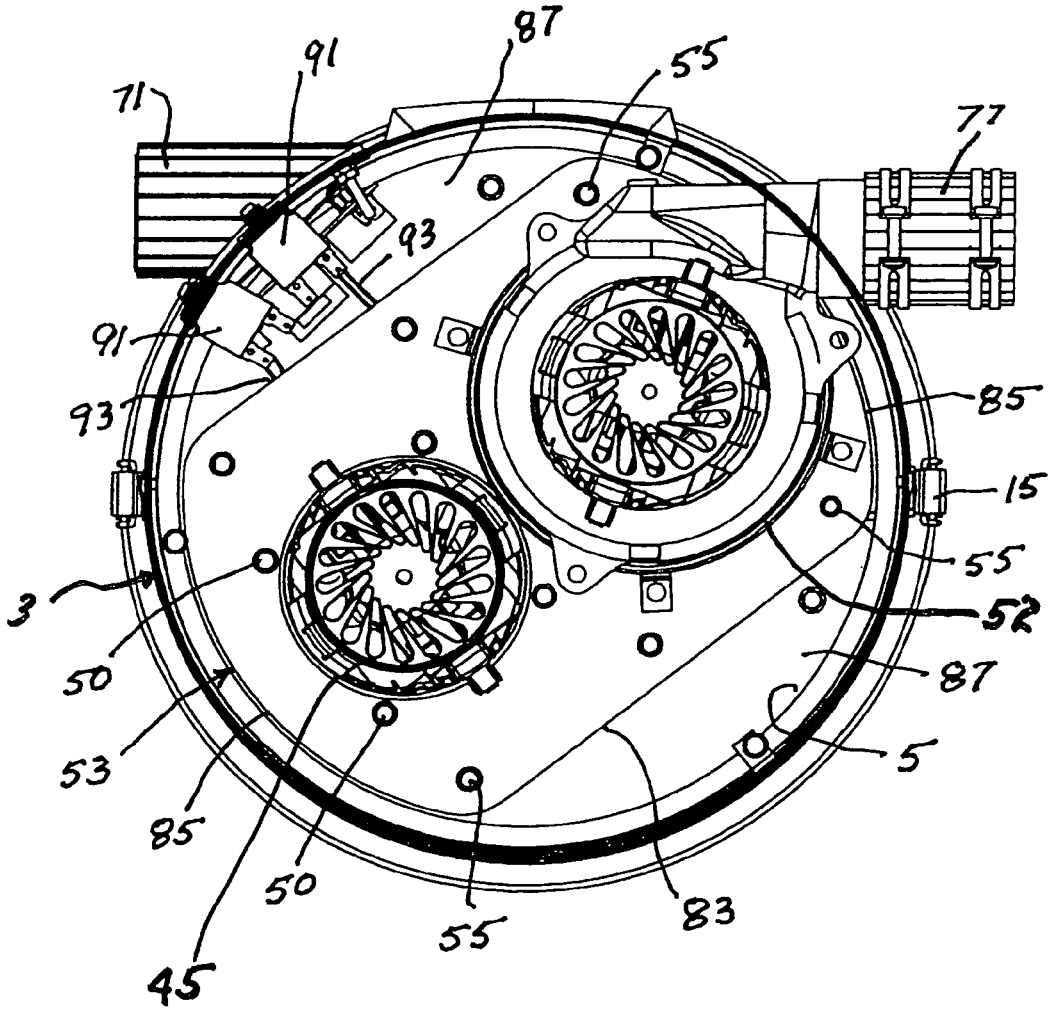
FIG. 7 is a top view of the vacuum unit of FIG. 1 with the top cap removed.

In accordance with the main feature of the invention, auxiliary plate 53 has a pair of opposed elongated flat sides 83 and a pair of opposed curved ends 85. The longitudinal length of plate 53 is approximately equal to and just slightly less than the diameter of top motor mounting plate 39. As shown in FIG. 7, elongated sides 83 provide a chord-like shaped space 87 between sides 83 and the inside surface of cylindrical body side wall 4, the purpose of which is discussed further below.

The manner of operation of auxiliary plate 53 is as follows: When vacuum producing motors 37 and 49 are in their assembled position within the interior of canister 1 (FIG. 2), and in particular in upper cylindrical body 3, lower motor 37 is removably seated within motor positioning ring 31 and gasket 35 on bottom plate 39 and extends upwardly through openings 43 and 59 formed in top mounting plate 39 and auxiliary plate 53, respectively. Fan housing 45 extends through opening 90 formed in top closure plate 7. Upper motor 49 (FIG. 4) is removably seated in motor positioning ring 63 which is attached to motor mounting plate 39. Motors 37 and 49 are connected to an electrical control circuit or printed circuit board indicated collectively at 91, in FIG. 7 by conductors 93. Electrical components 91 usually are mounted on canister side wall 4 in top motor chamber 22 above motor mounting plate 39 in most types of central vacuum units. It is these electrical components 91, as well as other control mechanisms (not shown) which are mounted within chamber 22 that heretofore had to be removed in order to permit removal of upper motor mounting plate 39 from within the canister to provide access to lower motor 37 in order to replace motor 37 or perform maintenance thereon. This removal of components 91 increases considerably the time and expense for replacing or repairing lower motor 37.

Figure 6:
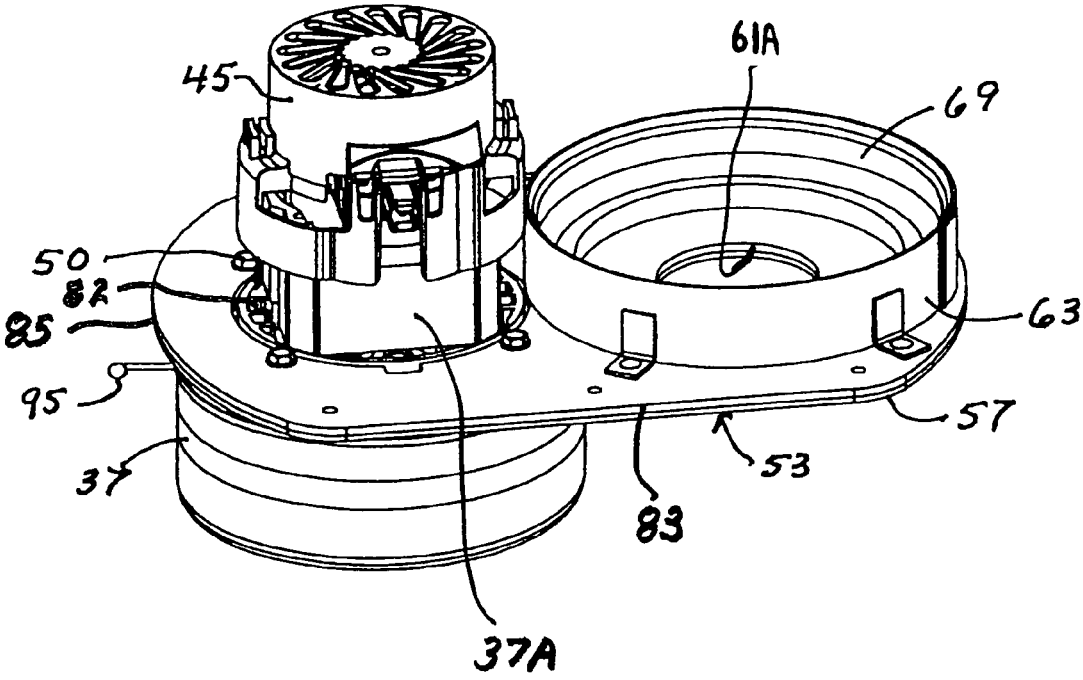
FIG. 6 is an enlarged perspective view of the auxiliary mounting plate having the first motor attached thereto.

However, in accordance with the invention, maintenance personnel merely remove top end cap 9 and top closure plate 7 and six fasteners 55 which mount auxiliary plate 53 to top motor mounting plate 39. The maintenance personnel then remove the auxiliary plate and motor 37 as shown in FIG. 6 by lifting upwardly on auxiliary plate 53 after having removed upper motor 49 from within its seated position in ring 63.

Removal of auxiliary plate 53 brings with it lower motor 37 which passes easily through opening 43 formed in top motor mounting plate 39 from within its seated position in lower motor mounting ring 31 and gasket 35. Spaces 87 (FIG. 7) enable auxiliary plate 53 to pass easily by any side wall mounted components such as the electrical components 91, avoiding removal of these components from within the canister. Thus, only the disconnection of electrical conductors 93 from electrical components 91 and removal of the motor ground wires 95 (FIG. 5) from its connection is required. Lower motor 37 then can be replaced easily from its attachment to auxiliary plate 53 by the removal of fasteners 50. Auxiliary plate 53 and a new or repaired motor 37 can be lowered back into position onto top mounting plate 39 and secured thereto by fasteners 55. Conductors 93 and ground wires 95 then are reconnected to the appropriate electrical components 91, after which top closure plate 7 and top end cap 9 are replaced on the top of cylindrical body 3.

Thus, auxiliary plate 53 and its configuration forming passages or spaces 87 between the plate and canister side wall adjacent any components mounted thereon, enables auxiliary plate 53 and attached motor 37 to be easily removed from and replaced within the canister through top opening 5. Top motor 49 is easily removed through the open top of the canister since it is only seated within motor ring 63 and is readily accessible through the open top of the canister. Thus, a repairman after removal of top end cap 9 and top closure plate 7 merely disconnects the motors from their electrical connections and removes a plurality of fasteners is able to lift auxiliary plate 53 and attached motor 37 from and through the open top for maintenance or replacement without removing any of the electrical components or other components which heretofore were attached to the canister side wall which heretofore had to be removed to permit the passage of lower mounting plate 19 and motor 37 from within the canister.

It is readily understood that auxiliary plate 53 could have other configurations than that shown in the drawings, in order to provide at least one clearance space 87 so long as it has at least one dimension less than the internal diameter of cylindrical body 3 which is formed adjacent to the side wall mounted components requiring clearance when removing auxiliary plate 53 and lower motor 37 from within the canister.

A plurality of openings 97, a pressure release valve 99 and a power supply cord 100 are shown in the drawings and are standard features in prior art vacuum canisters and need not be described in further detail.

As is well known in the art, cooling air enters motors 37 and 49 through fan housings 45 and 52 and passes out through openings 82 into chamber 22 where it is exhausted through vent openings 97 to the surrounding atmosphere.

Motors 37 and 49 of the present invention are mounted in series, meaning that the motors are supported at different elevations within the canister instead of the same elevation on a single support plate.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A vacuum canister for use in a central vacuum system, said canister comprising:

a body forming an interior chamber with a top opening communicating with said interior chamber;

an end closure plate removably mounted on the canister body and closing the top opening;

a first support plate mounted in the interior chamber below the end closure plate and forming a first motor chamber;

a second support plate mounted in the interior chamber and spaced from said first support plate below the end closure plate and forming a second motor chamber;

an auxiliary plate removably mounted on the second support plate;

control components mounted within the interior chamber of the canister body between the second support plate and the end closure plate;

a first motor removably supported on the first support plate in the first motor chamber and extending through aligned openings formed in the second support plate and auxiliary plate and into the second motor chamber and attached to the auxiliary plate;

a second motor supported on the second support plate and located in the second motor chamber; and said auxiliary plate being configured to have at least one dimension sufficient to permit said auxiliary plate and the first motor attached thereto to be removed through the top opening of canister and past the control components after the end closure plate has been removed from the canister body.

2. The vacuum canister defined in claim 1 wherein the first and second motors communicate with openings formed in the end closure plate for drawing cooling air through said motors and into the second motor chamber.

3. The vacuum canister defined in claim 2 in which an air exhaust communicates with the second motor chamber.

4. The vacuum canister defined in claim 3 wherein the canister body includes a cylindrical side wall; and wherein a plurality of air vents are formed in the canister side wall in fluid communication with the second motor chamber for discharging the cooling air from said second motor chamber.

5. The vacuum canister defined in claim 1 wherein a vacuum duct communicates with a dirt collection chamber formed in the interior chamber below the first support plate for delivering dirt laden air into said dirt collection chamber; in which a cyclone tube is mounted within the dirt collection chamber for separating dirt particles from the incoming dirt laden air; and in which a dirt collection container communicates with the dirt collection chamber for receiving dirt particles separated from the incoming dirt laden air.

6. The vacuum canister defined in claim 1 wherein the auxiliary plate is oval-shaped having a pair of opposed flat sides and a pair of opposed curved ends.

7. The vacuum canister defined in claim 6 wherein the canister body is cylindrical having an internal diameter; and wherein the auxiliary plate has a longitudinal length extending between the curved ends which is substantially equal to but less than the internal diameter of the canister body.

8. The vacuum canister defined in claim 1 wherein the auxiliary plate is an elongated flat plate formed of metal; and in which an elastomer gasket is mounted between the auxiliary plate and the second support plate.

9. The vacuum canister defined in claim 1 wherein the auxiliary plate is removably attached to the second support plate by a plurality of fasteners.

10. The vacuum canister defined in claim 1 wherein the first motor is removably seated within a first positioning ring attached to the first support plate; and in which the second motor is removably seated within a second positioning ring attached to the auxiliary plate.

11. The vacuum canister defined in claim 1 wherein the first motor is attached to the auxiliary plate by a plurality of fasteners.

12. The vacuum canister defined in claim 1 wherein the second support plate is spaced from and supported on the first support plate by a plurality of posts.

13. The vacuum canister defined in claim 1 wherein the body includes a cylindrical side wall; in which the first and second support plates are disc-shaped and complementary to an internal diameter of the cylindrical side wall; and in which each of the motor support plates has a peripheral gasket providing a seal with the side wall.

14. A method of removing a pair of motors mounted in series within an interior of a canister of a vacuum cleaning system through an end opening of the canister and past control components mounted within the interior of the canister comprising the steps of:

removing an end closure cap of the canister which closes the end opening of the canister providing access to the interior of the canister;

providing an auxiliary plate mounted on an upper motor support plate within the canister interior, wherein said auxiliary plate has at least one dimension small enough to enable said auxiliary plate to move past the control components mounted within the canister interior above the auxiliary plate and out of the canister through the end opening;

removing an upper motor supported on the upper motor support plate which is mounted in the canister interior spaced from the end closure cap;

removing fasteners securing the auxiliary plate to the upper motor support plate;

manually lifting the auxiliary plate from the canister interior through the end opening including a lower motor fastened to said auxiliary plate; and removing the lower motor from the auxiliary plate by removing fasteners fastening said lower motor to said auxiliary plate after lifting the auxiliary plate and attached lower motor from within the canister interior through the end opening.

15. The method defined in claim 14 including the step of providing the auxiliary plate with an elongated oval configuration with a pair of opposed straight sides and pair of opposed curved ends.

16. The method defined in claim 14 including the step of locating an elastomeric gasket between the auxiliary plate and the upper motor support plate.

17. The method defined in claim 14 including the steps of removably supporting the lower motor on a lower motor support plate located below the upper motor support plate; and removing the lower motor from its supported position on the lower motor support plate and passing said lower motor through an opening formed in the upper motor support plate when lifting the auxiliary plate and attached lower motor from the canister interior.

18. A dual motor assembly for mounting within a canister of a vacuum cleaning unit, said assembly comprising:

an elongated auxiliary plate having top and bottom surfaces and a width and a length, said width being less than the length;

a support plate supporting the auxiliary plate thereon;

a pair of aligned openings formed in the support plate and the auxiliary plate;

a first motor support mounted on the top surface of the auxiliary plate for removably supporting a first motor on said auxiliary plate; and a second motor attached by fasteners to the auxiliary plate; said second motor extending through the pair of aligned openings in the support plate and the auxiliary plate, said second motor having a first portion below the support plate and the auxiliary plate and having a second portion above the top surface of the support plate adjacent the first motor support, the opening of the pair of aligned openings which is formed in the support plate being large enough to permit the first portion of the second motor to pass therethrough.

19. The dual motor assembly defined in claim 18 wherein the elongated auxiliary plate has an oval-shaped configuration and is formed of metal having a pair of spaced straight sides terminating in curved ends; in which the support plate is disc-shaped; and in which an elastomeric gasket is attached to a peripheral edge of said support plate.

* * * * *